US009631443B2

(12) United States Patent
Folk

(10) Patent No.: US 9,631,443 B2
(45) Date of Patent: Apr. 25, 2017

(54) APPARATUS FOR DELIVERING DRILL PIPE TO A DRILL RIG

(71) Applicant: COAX Technology Inc., Edmonton (CA)

(72) Inventor: Robert Folk, Edmonton (CA)

(73) Assignee: COAX Technology, Inc., Edmonton, AB (CA)

( * ) Notice: Subject to any disclaimer, the term of this patent is extended or adjusted under 35 U.S.C. 154(b) by 120 days.

(21) Appl. No.: 14/380,278

(22) PCT Filed: Feb. 22, 2013

(86) PCT No.: PCT/CA2013/050138
§ 371 (c)(1),
(2) Date: Aug. 21, 2014

(87) PCT Pub. No.: WO2013/123602
PCT Pub. Date: Aug. 29, 2013

(65) Prior Publication Data

US 2015/0008038 A1 Jan. 8, 2015

Related U.S. Application Data

(60) Provisional application No. 61/601,817, filed on Feb. 22, 2012.

(51) Int. Cl.
*E21B 19/15* (2006.01)

(52) U.S. Cl.
CPC ..... *E21B 19/155* (2013.01)

(58) Field of Classification Search
CPC ..... E21B 19/14; E21B 19/15; E21B 19/155; B65G 1/0442
See application file for complete search history.

(56) References Cited

U.S. PATENT DOCUMENTS 4,235,566 A * 11/1980 Beeman ..... E21B 19/155 175/85
4,403,898 A 9/1983 Thompson
2005/0152772 A1* 7/2005 Hawkins, III ..... E21B 19/155 414/22.54
2009/0053013 A1* 2/2009 Maltby ..... E21B 19/15 414/22.61

(Continued)

FOREIGN PATENT DOCUMENTS

WO WO03/093629 A1 11/2003
WO WO2006/128300 A1 12/2006

OTHER PUBLICATIONS

International Search Report for PCT/CA2013/050138 dated May 16, 2013 (2 pages).

*Primary Examiner* — Robert E Fuller
*Assistant Examiner* — Steven MacDonald
(74) *Attorney, Agent, or Firm* — Vincent J. Allen; James H. Ortega; Carstens & Cahoon, LLP

(57) ABSTRACT

An apparatus for delivering drill pipe has a support frame, a catwalk platform, and a slide platform that are pivotally connected together. A drill pipe rack, a chain drive, and a kicker direct the drill pipe to and from the catwalk platform. A hydraulically actuated piston lifts the catwalk platform and slide platform into alignment to create a single inclined delivery platform extending from the ground to the rig floor. A powered means lifts or lowers the drill pipe along the delivery platform.

23 Claims, 19 Drawing Sheets

(56) References Cited

U.S. PATENT DOCUMENTS

| | | | | |
|---|---|---|---|---|
| 2010/0163247 | A1* | 7/2010 | Wright | E21B 19/155<br>166/380 |
| 2011/0030942 | A1 | 2/2011 | Orgeron | |
| 2011/0070054 | A1* | 3/2011 | Crossley | E21B 19/14<br>414/22.61 |
| 2011/0259640 | A1* | 10/2011 | Gerber | E21B 19/14<br>175/52 |

* cited by examiner

APPARATUS FOR DELIVERING DRILL PIPE TO A DRILL RIG

FIELD OF THE INVENTION

The present invention is directed to an apparatus for delivering lengths of drill pipe to a drill rig. In particular, the apparatus is suited to moving drill pipe to and from the rig floor of a drilling rig, in an automated manner.

BACKGROUND OF THE INVENTION

On drilling rigs, drill pipe is raised from the ground to the rig floor, and conversely lowered from the rig floor to the ground by means of a catwalk and slide. A catwalk typically consists of a long, rectangular platform usually made of steel that is located at the bottom of the slide and oriented perpendicularly to the V-door. The catwalk platform is used as a staging area for drill pipe that is about to be lifted to the rig floor, or which has been lowered from the rig floor. The slide is an inclined plane below the V-door that connects the rig floor to the catwalk. It is frequently a reinforced steel plate with a central groove, which acts as a guide when pipes are dragged or pushed to and from the rig floor.

There are a number of mechanized systems designed to lift or push drill pipe along the catwalk to the slide and up to the V-door. A commonly used conventional system uses a skate that pushes the pipe along the catwalk and up the inclined slide. However, the skate delivers the drill pipe to the rig floor in an uncontrolled and projectile-like manner posing a safety risk to those working in proximity to the V-door. Furthermore, a significant amount of force is required to overcome frictional and gravitational forces when the drill pipe is pushed up the slide in the conventional system. Also, the steepness of the slide in the conventional system poses a significant risk when used for access by workers. Conventional delivery systems are also restricted to the delivery of drill pipe and occasionally, lighter rig equipment such as slips. Further still, many conventional systems can deliver only one drill pipe per delivery cycle.

What is needed is an apparatus for delivering a drill pipe between the ground and a rig floor that mitigates the limitations of a conventional catwalk and slide system.

SUMMARY OF THE INVENTION

In one aspect, the present invention provides an apparatus for delivering a drill pipe to a drill rig. The apparatus comprises: a support frame having a horizontal ground section and a pivotally connected rig section; a catwalk platform having a first end pivotally connected to one end of the ground section, and a second end; a slide platform having a first end pivotally connected to the second end of the catwalk platform, and a second end pivotally and translationally connected to one end of the rig section; a drill pipe skate or conveyor for moving the drill pipe along a path along the catwalk platform and the slide platform; and a hydraulically actuated piston assembly connected to either the catwalk platform or the slide platform, or both, to pivot the catwalk platform and the slide platform between a loading configuration and a delivery configuration. In the loading configuration, the catwalk platform is substantially horizontal and the slide platform is vertically inclined from the first end of the slide platform to the second end of the slide platform. In the delivery configuration, the catwalk platform and the slide platform are in substantially coplanar alignment to define a single delivery platform from the first end of the catwalk platform to the second end of the slide platform.

In one embodiment of the apparatus, the catwalk platform comprises a first segment and a second segment, wherein the first segment comprises the first end of the catwalk platform, the second segment comprises the second end of the catwalk platform, and the first segment and the second segment are releasably connected at a point on the catwalk platform intermediate to the first end and the second end of the catwalk platform.

In one embodiment of the apparatus, the means for moving the drill pipe comprises a powered skate. In one embodiment of the apparatus, the means for moving the drill pipe comprises a conveyor belt.

In one embodiment of the apparatus, the apparatus further comprises an extension platform that telescopically extends from the delivery platform away from the ground end.

In one embodiment of the apparatus, the rig section may be pivoted into a transportation configuration in which the ground section and the rig section are folded against each other. In one embodiment, in the transportation configuration, the ground section, the rig section, the catwalk platform and the slide platform are folded against each other.

In one embodiment of the apparatus, the apparatus further comprises a drill pipe rack pivotally connected to the support frame for moving to the drill pipe rack from a transportation configuration in which the drill pipe rack is folded against the support frame to the loading configuration in which the drill pipe rack extends outward from the catwalk platform. In one embodiment, the apparatus further comprises an extendible leg attached to the drill pipe rack, wherein the extension of the leg varies the height of the leg to vary the inclination of the drill pipe rack relative to the catwalk platform.

In one embodiment of the apparatus, the apparatus further comprises a conveyor to selectively laterally transport the drill pipe along the catwalk platform either to or away from the path.

In one embodiment of the apparatus, the apparatus further comprises an indexer to selectively laterally transport the drill pipe either to or away from the path.

In one embodiment of the apparatus, the apparatus further comprises a hydraulically actuated kicker positioned to selectively prevent the drill pipe from entering the path or to kick the drill pipe out of the path, or both.

In one embodiment of the apparatus, the apparatus further comprises a removable basket engaged by the means for moving the drill pipe to, when the apparatus is the delivery configuration, travel along the delivery platform.

In another aspect, the present invention provides a method for moving a drill pipe between a ground surface and a rig floor. The method comprises the steps of:

(a) providing a substantially horizontal catwalk platform on the ground surface, a slide platform pivotally connected to the catwalk platform and extending to the rig floor, and a means for moving the drill pipe along a path from the catwalk platform to the slide platform;

(b) pivoting the catwalk platform and the slide platform into substantially coplanar alignment to define a vertically inclined delivery platform extending from the ground surface to the rig floor; and (c) powering the means for moving the drill pipe along the path.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The invention relates to an apparatus and a method for delivering drill pipe to and from a drilling rig. When describing the present invention, all terms not defined herein have their common art-recognized meanings. To the extent that the following description is of a specific embodiment or a particular use of the invention, it is intended to be illustrative only, and not limiting of the claimed invention. The invention will now be described having regard to the accompany Figures.

In this description the term "drill pipe" or "pipe" shall refer to any type of oilfield pipe or tubular used in conjunction with drilling, servicing or production operations of a wellbore, including without limitation, drill pipe, drill collars, pup joints, casing, production tubing, and drill pipeline.

Figure 1:
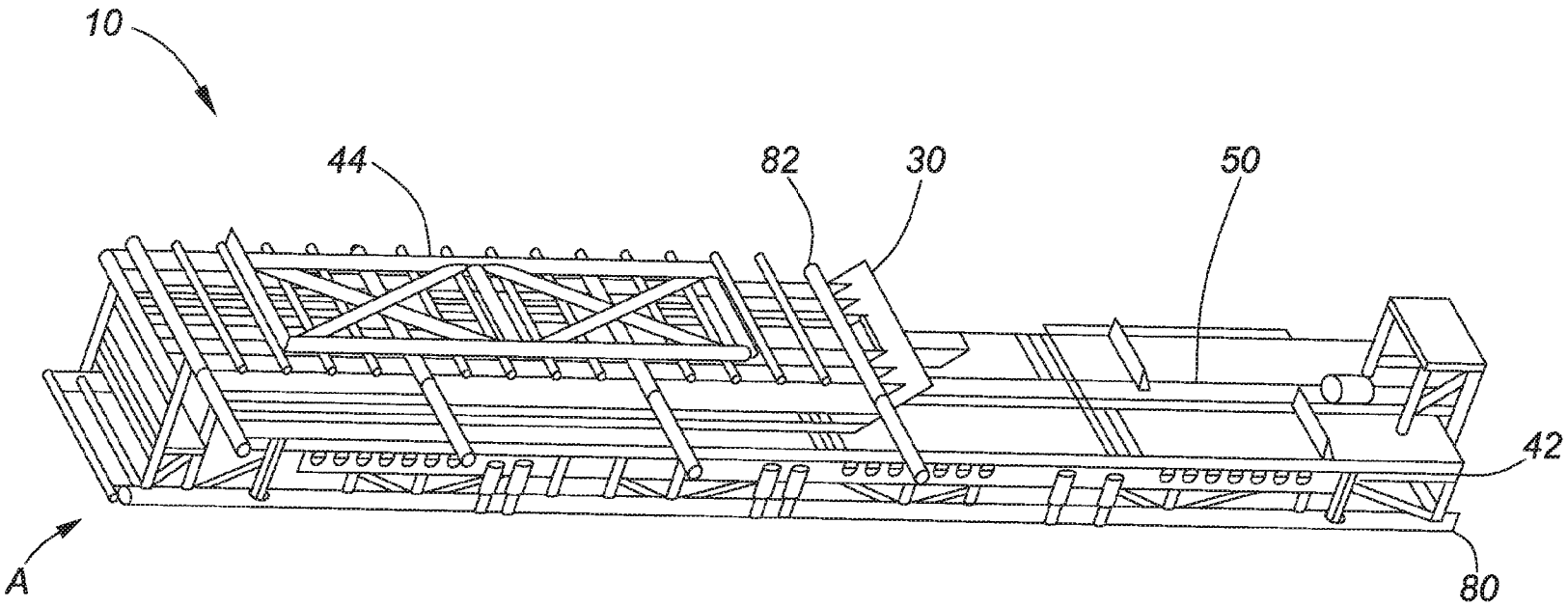
FIG. 1 is a perspective view of one embodiment of the apparatus of the present invention in the transportation configuration.
Figure 2:
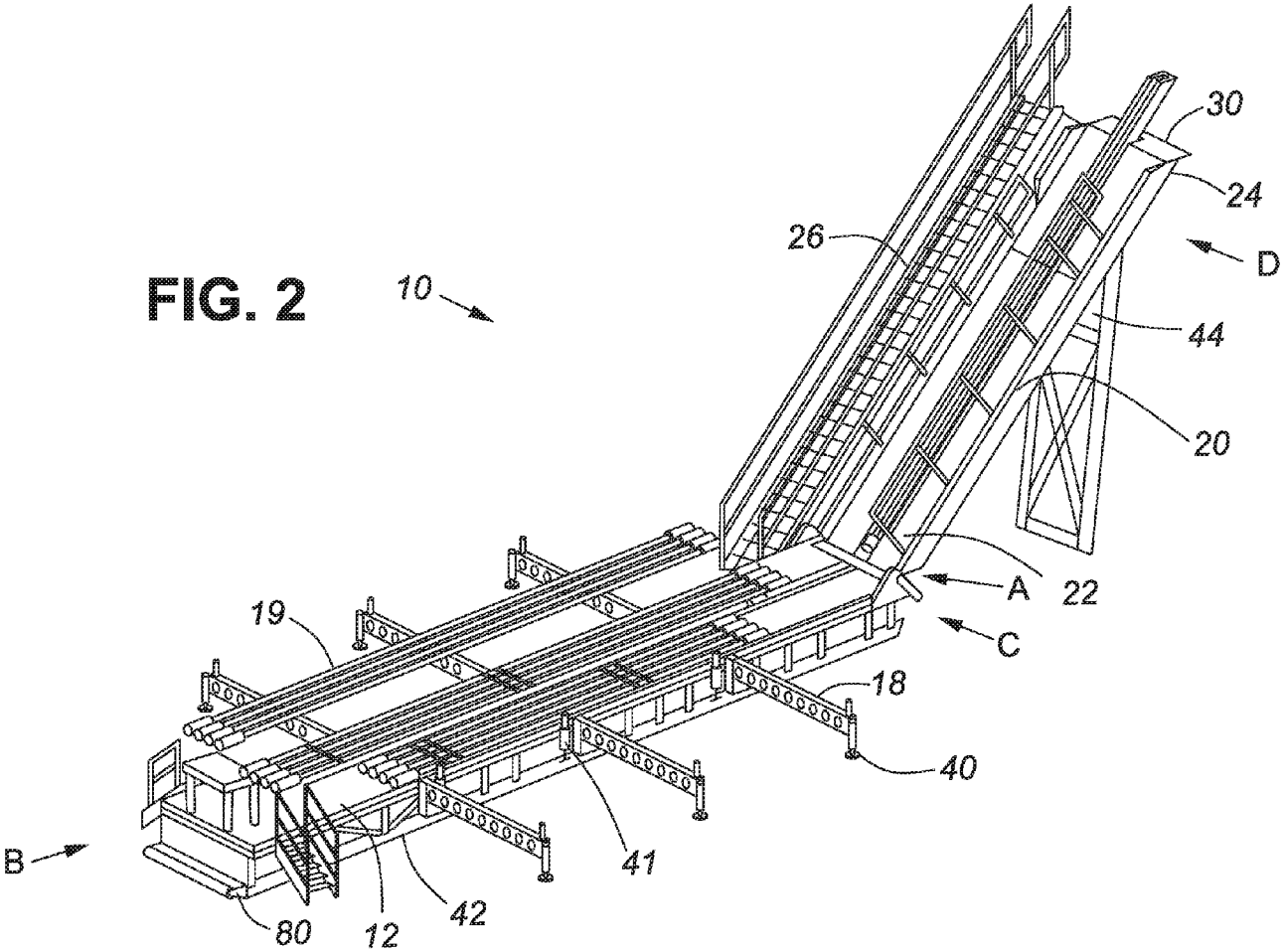
FIG. 2 is a perspective view of one embodiment of the apparatus of the present invention in the loading configuration.
Figure 3:
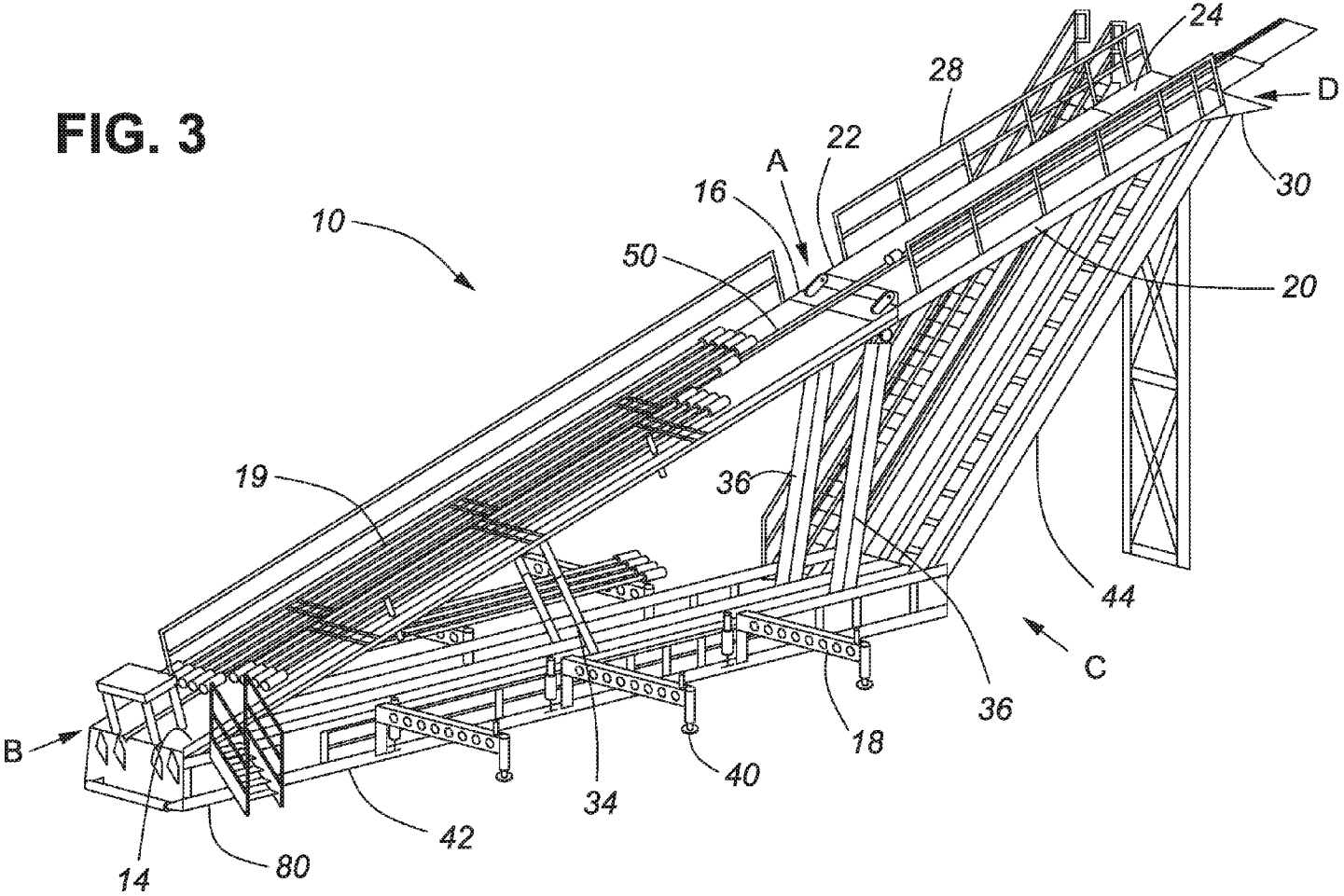
FIGS. 3 through 5 are different perspective views of one embodiment of the apparatus of the present invention in the delivery configuration.
Figure 4:
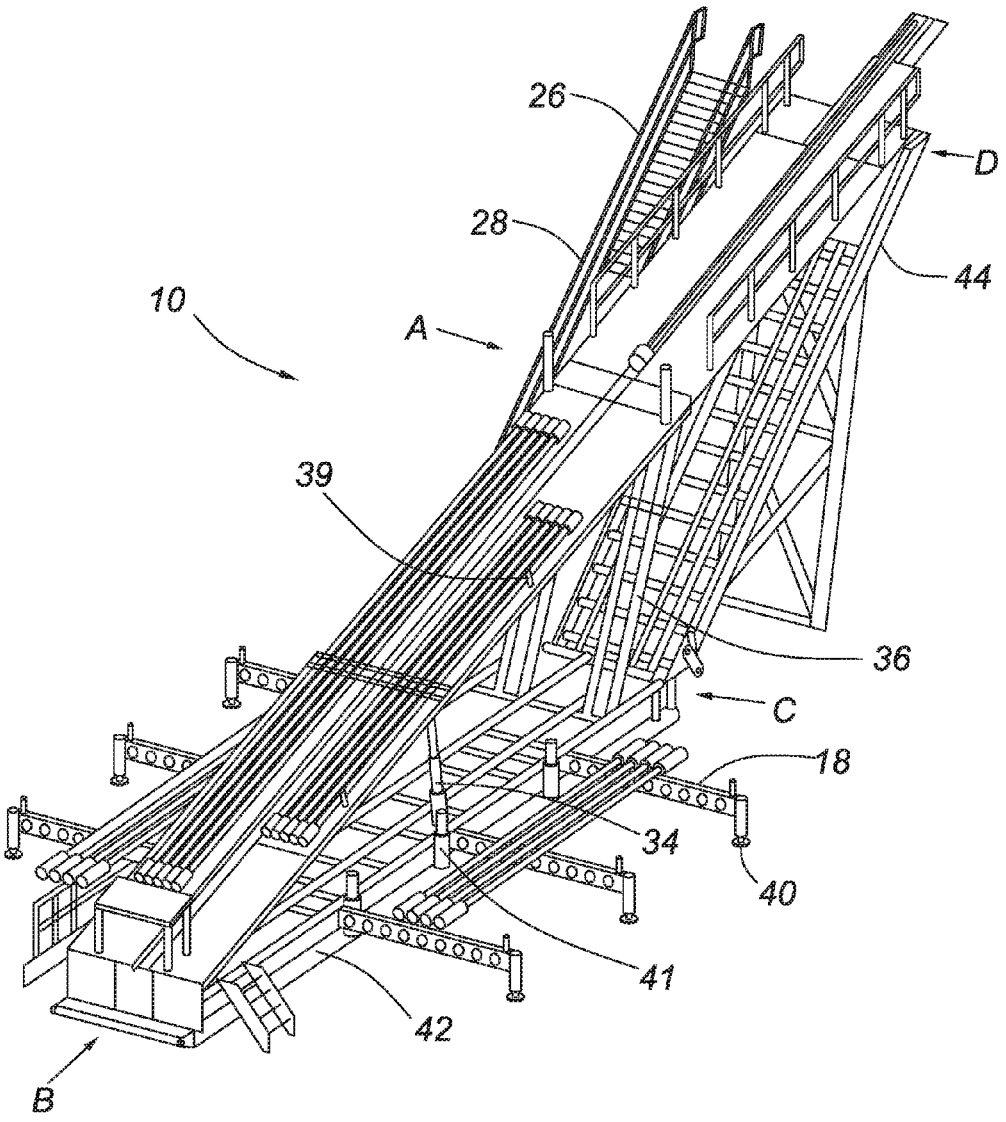
Figure 5:
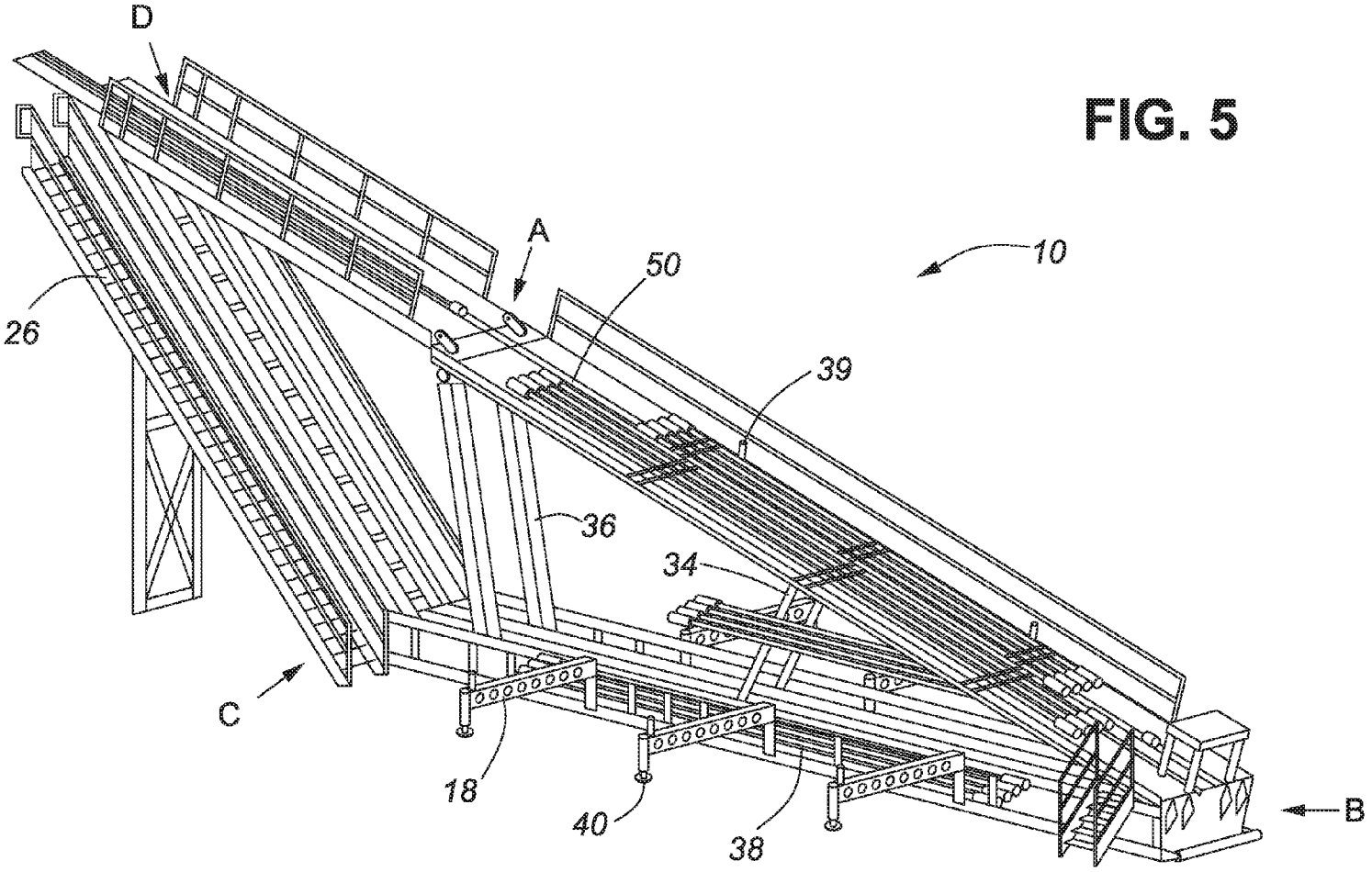

FIGS. 1 through 5 show one embodiment of the apparatus (10) of the present invention in different configurations. In general, the apparatus (10) comprises a support frame having a ground section (42) and a rig section (44), a catwalk platform (12), a slide platform (20), a skate or conveyor for moving the drill pipe (50) and a hydraulically actuated piston assembly (38). FIG. 1 depicts the apparatus (10) in a transportation configuration in which the ground and rig sections (42, 44) of the support frame are folded against each other, as well as the catwalk platform (12) and the slide platform (20). FIG. 2 shows the apparatus (10) in its loading configuration in which the catwalk platform (12) is substantially horizontal, while the slide platform (20) is inclined. FIGS. 3 to 5 show the apparatus (10) in its delivery configuration in which the catwalk platform (12) and the slide platform (20) are in substantially coplanar alignment to define a single delivery platform that is inclined.

The support frame may comprise any suitably sized and constructed structure to support the catwalk platform (12) and the slide platform (20). The support frame has a ground end (80) at one end of its ground section (42) and a rig end (82) at the opposing end of the rig section (44). The rig end is elevated when the apparatus (10) is in the loading configuration. The ground section (42) and the rig section (44) are pivotally connected by hinged connection (C). The hinged connection (C) allows the apparatus (10) to be folded into the transportation configuration shown in FIG. 1 and unfolded into the loading configuration shown in FIG. 2. Further, the hinged connection (C) allows the position of the rig end (82) relative the ground to be varied so that the apparatus (10) may be used with drilling rigs having rig floors at different heights.

Figure 13:
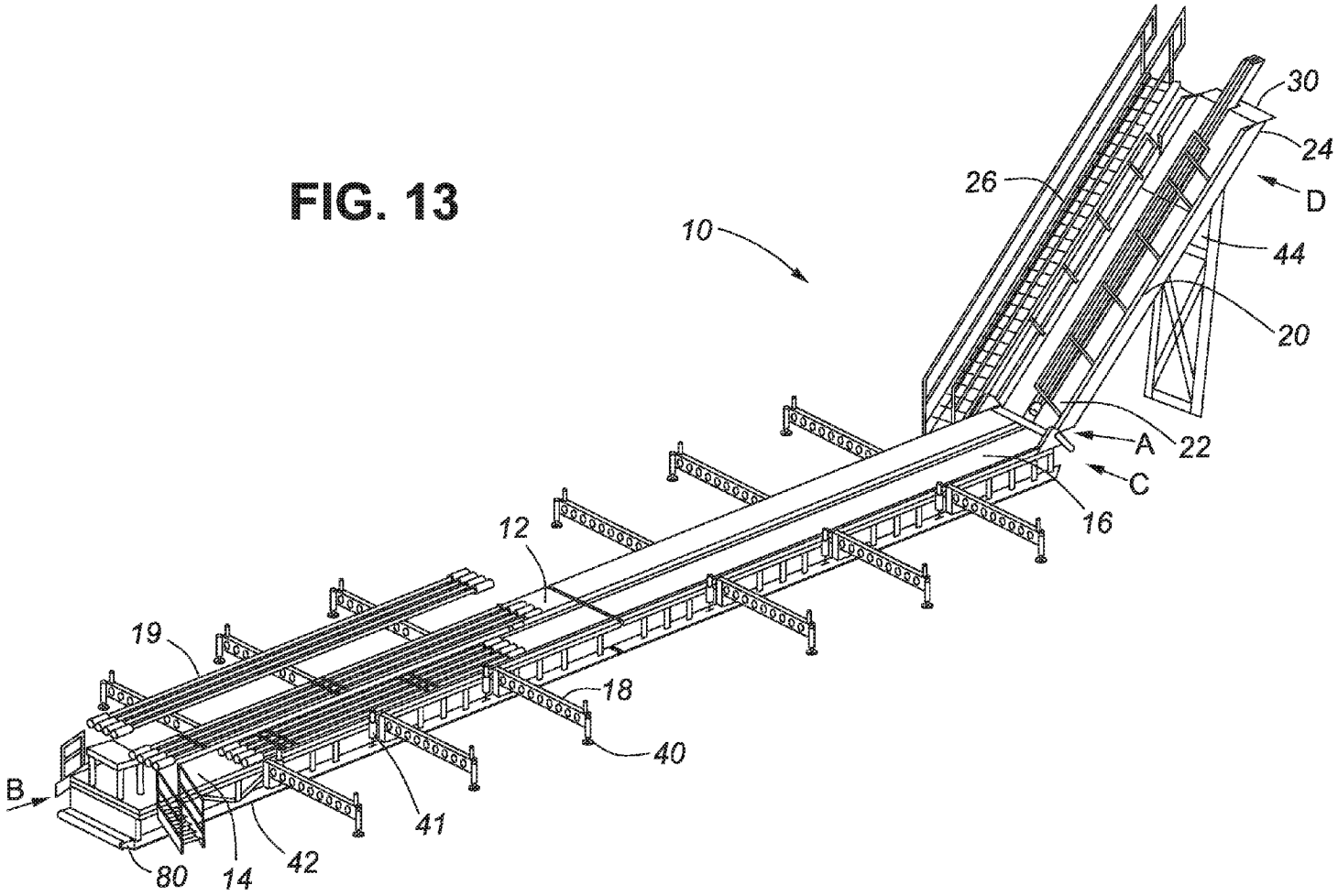
FIG. 13 is a perspective view of one embodiment of the apparatus of the present disclosure in the loading configuration.
Figure 14:
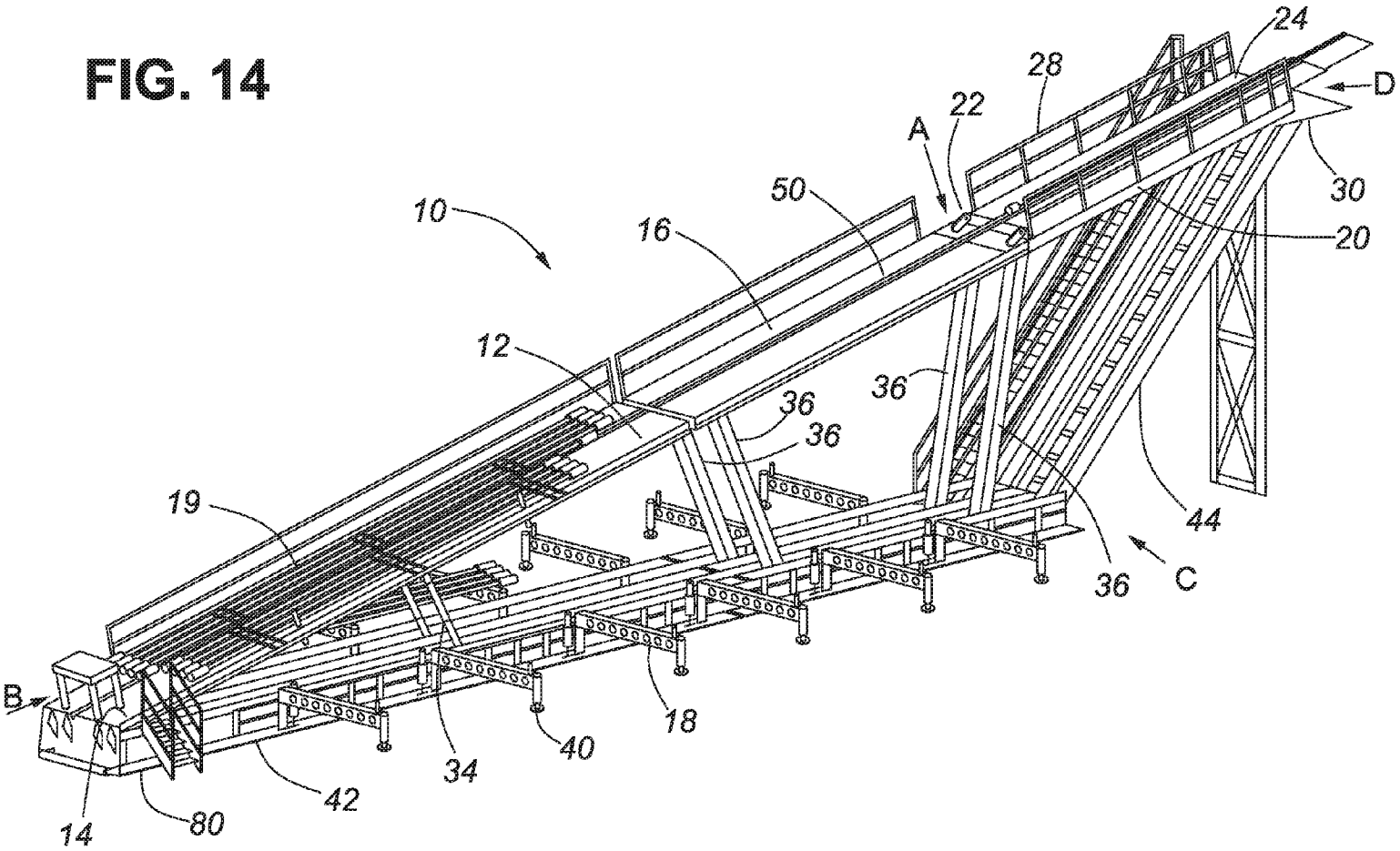
FIG. 14 is a perspective view of one embodiment of the apparatus of the present disclosure in the delivery configuration.

The catwalk platform (12) may comprise any suitably sized and constructed surface to support a drill pipe lengthwise in the path travelled by the drill pipe skate or conveyor (50). In the embodiment shown in FIGS. 1 to 5, the catwalk platform (12) is an elongated rectangular plate having a first end (14) and a second end (16). The first end (14) of the catwalk platform (12) is pivotally connected to the ground end (80) of the ground section (42) by hinged connection (B). In one embodiment not shown, the catwalk platform (12) may be made of several segments that may be pinned together. For example, the catwalk platform (12) may comprise two segments, each having a length of 30 feet. One of the segments comprises the first end (14), while the other segment comprises the second end (16) (see FIGS. 13 and 14). When the apparatus is in use, the adjacent ends of the two segments are pinned together. When the apparatus is in the transportation configuration, the two segments can be unpinned from each other to make the apparatus (10) more compact so that it can be transported more easily in congested environments.

The slide platform (20) may comprise any suitably sized and constructed surface to support a drill pipe lengthwise in the path travelled by the powered means (50). In the embodiment shown in FIGS. 1 to 5, the slide platform (20) is an elongated rectangular plate having a first end (22) and a second end (24). The first end (22) of the slide platform (20) is pivotally connected to the second end (16) of the catwalk platform (12) by a hinged connection (A). The second end (24) of the slide platform (20) is pivotally and translationally connected to the rig end (82) of the rig section (44) of the support frame by connection (D). In one embodiment, connection (D) comprises a primary roller upon which the slide platform rests, and secondary rollers that fit between the flanges of an I-beam section attached to the slide platform (20). The slide platform (20) also has safety railings (28) that can be used to aid access and which serve as safety stops to restrain drill pipes that become dislodged from the powered means (50) during the delivery to the rig floor.

The drill pipe skate or conveyor for moving the drill pipe may comprise any suitable means capable of pushing drill pipe along a path along the catwalk platform (12) and the slide platform (20). In one embodiment, as shown in the Figures, the skate or conveyor comprises a powered skate, which is well known in the art. In one embodiment, the skate (50) is self tensioning and does not require manual adjustment on set up of the apparatus (10). In one embodiment, the skate (50) is driven by two independent chain drives each having an ANSI 120 chain size, giving complete redundancy for safety and capabilities of a combined pushing force of up to 13,636 kg (30,000 lbs). In another embodiment, not shown, the means may comprise a conveyor on each of the catwalk platform (12) and the slide platform (20). In embodiments where the catwalk platform (12) is comprised of multiple segments, each of the segments may be provided with its own conveyor. The conveyor may comprise a conveyor belt or conveyor chain.

The piston assembly (38) may comprise any mechanical actuator that applies an axial force through an axial stroke, such as a hydraulic cylinder. The piston assembly (38) is connected to either the catwalk platform (12) or to the slide platform (20) to pivot the catwalk platform (12) and the slide platform (20) between the loading configuration and the delivery configuration. In one embodiment, the piston assembly (38) is mounted in the ground section (42) in a substantially horizontal orientation and connected to the catwalk platform (12) by retractable struts (36). One end of the struts (36) is pivotally connected to rollers that move on tracks (not shown) extending along the ground section (42) of the support frame. The other end of the struts (36) is pivotally connected to the second end (16) of the catwalk platform (12). When the apparatus is in the transportation configuration or the loading configuration as shown in FIG. 2, the hydraulic pistons (38) are fully retracted and the struts (36) are in a substantially horizontal orientation beneath the catwalk platform (12) within the ground section (42), and substantially parallel to both the catwalk platform (12) and ground section (42). Upon being extended, the pistons (38) push the connected end of the struts (36) so that they roll along the track towards the hinged connection (C). This causes the struts (36) to pivot into a more vertically inclined orientation and drive the second end (16) of the catwalk platform (12) upwards. Consequently, catwalk platform (12) pivots about hinged connection (B) into a more vertically inclined angle, while the slide platform (20) pivots about hinged connections (A) and about the primary roller of connection (D) to a less steeply inclined angle. Simultaneously, the second end (24) of the slide platform (20) translates away from the ground end (80) by rolling action of the primary and secondary rollers, so as to extend further over the plate (30). This continues until the catwalk platform (12) and the slide platform (20) are in substantially coplanar alignment to define the single vertically inclined delivery platform in the delivery configuration as shown in FIGS. 3 to 5.

In one embodiment, the apparatus also has access stairs (26) that are mounted on the driller's side of the rig section (44) of the support frame to facilitate access to and from the rig floor as shown in the Figures. In a preferred embodiment, the stairs (26) and the surfaces of the catwalk platform (12) and the slide platform (20) are coated in an anti-slip covering to promote worker safety.

Figure 10A:
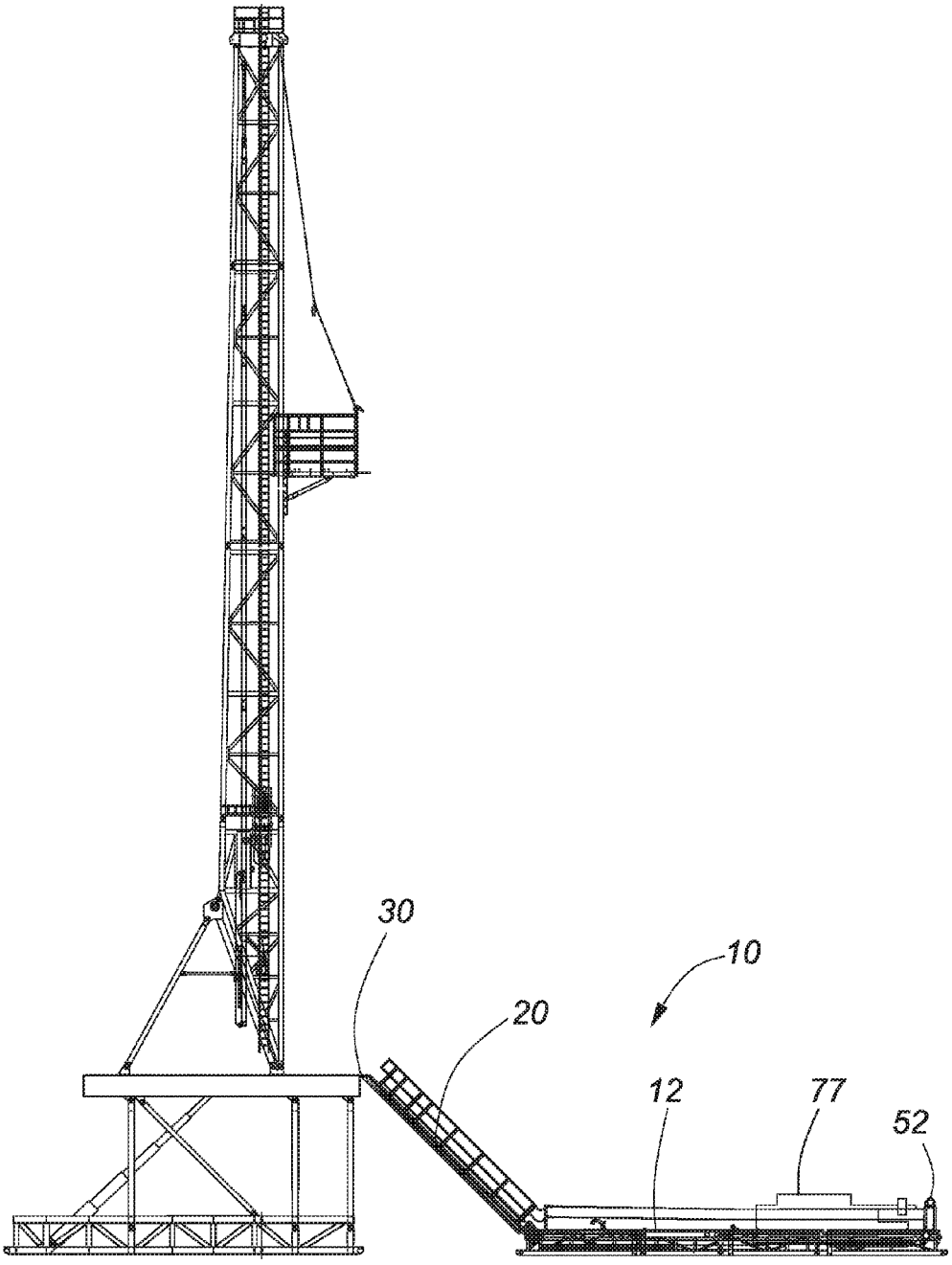
FIGS. 10A through 10D are elevation views of one embodiment of the apparatus of the present invention in conjunction with a drilling rig, showing the apparatus in different configurations.
Figure 10B:
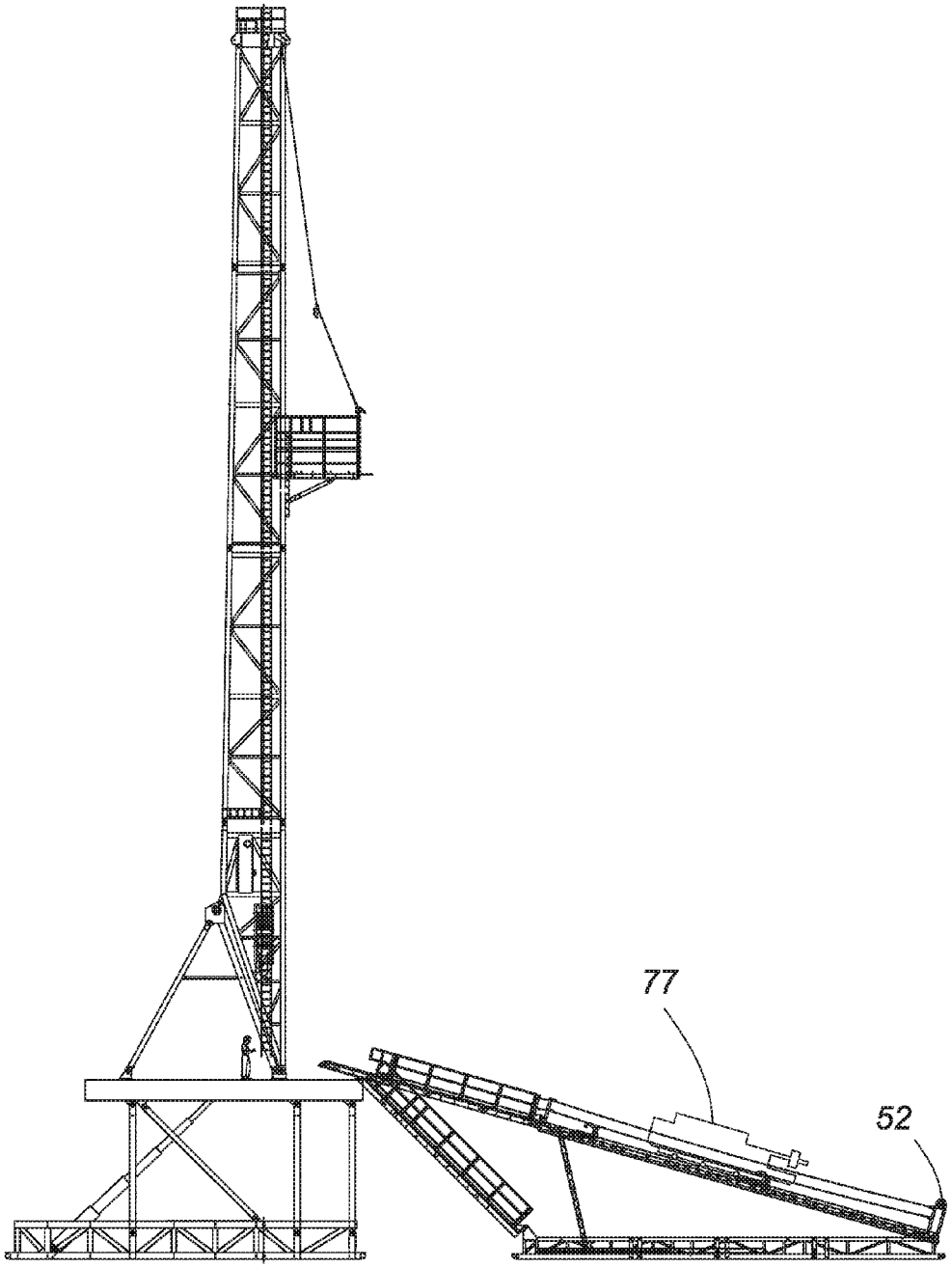
Figure 10C:
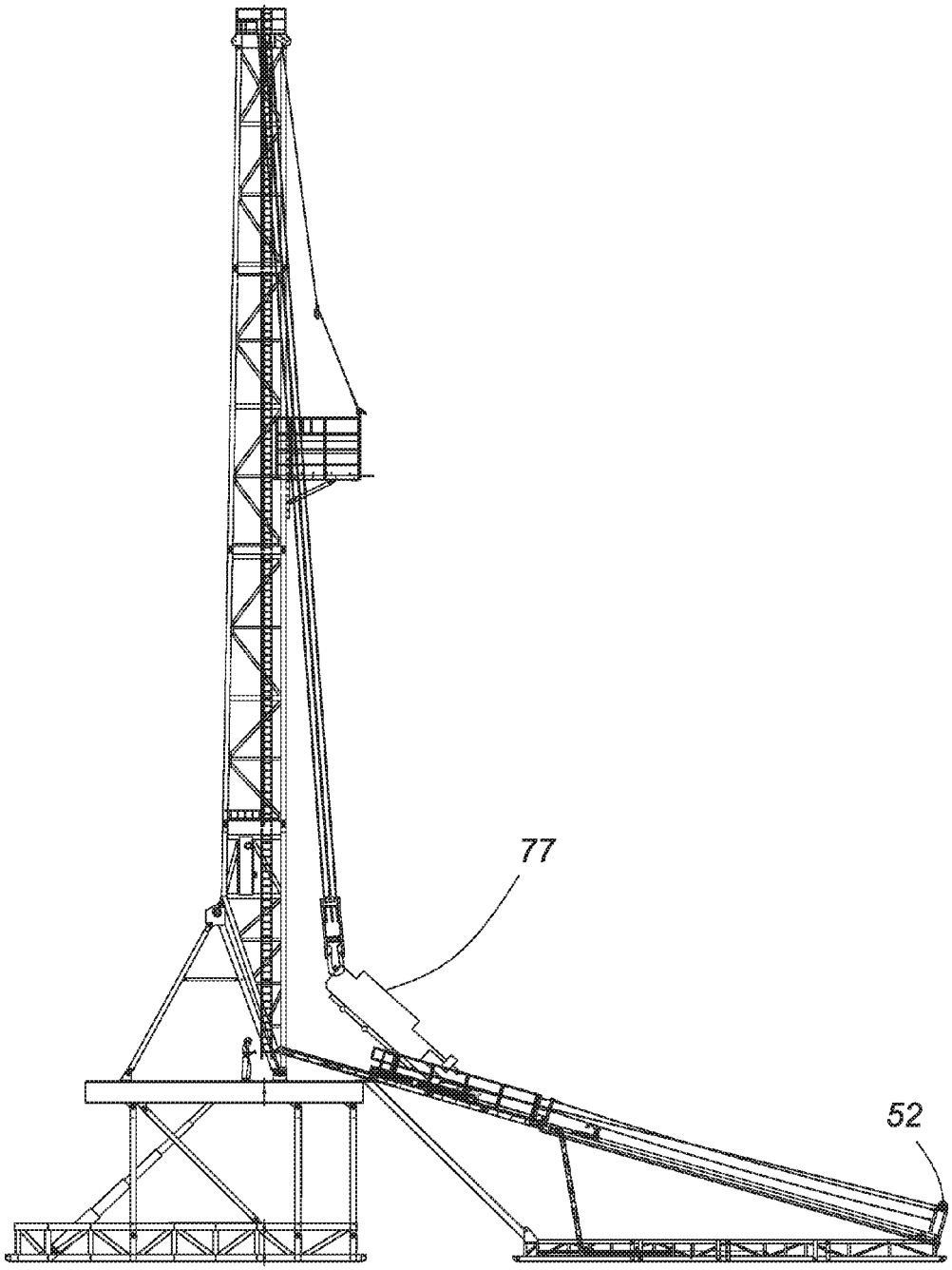
Figure 10D:
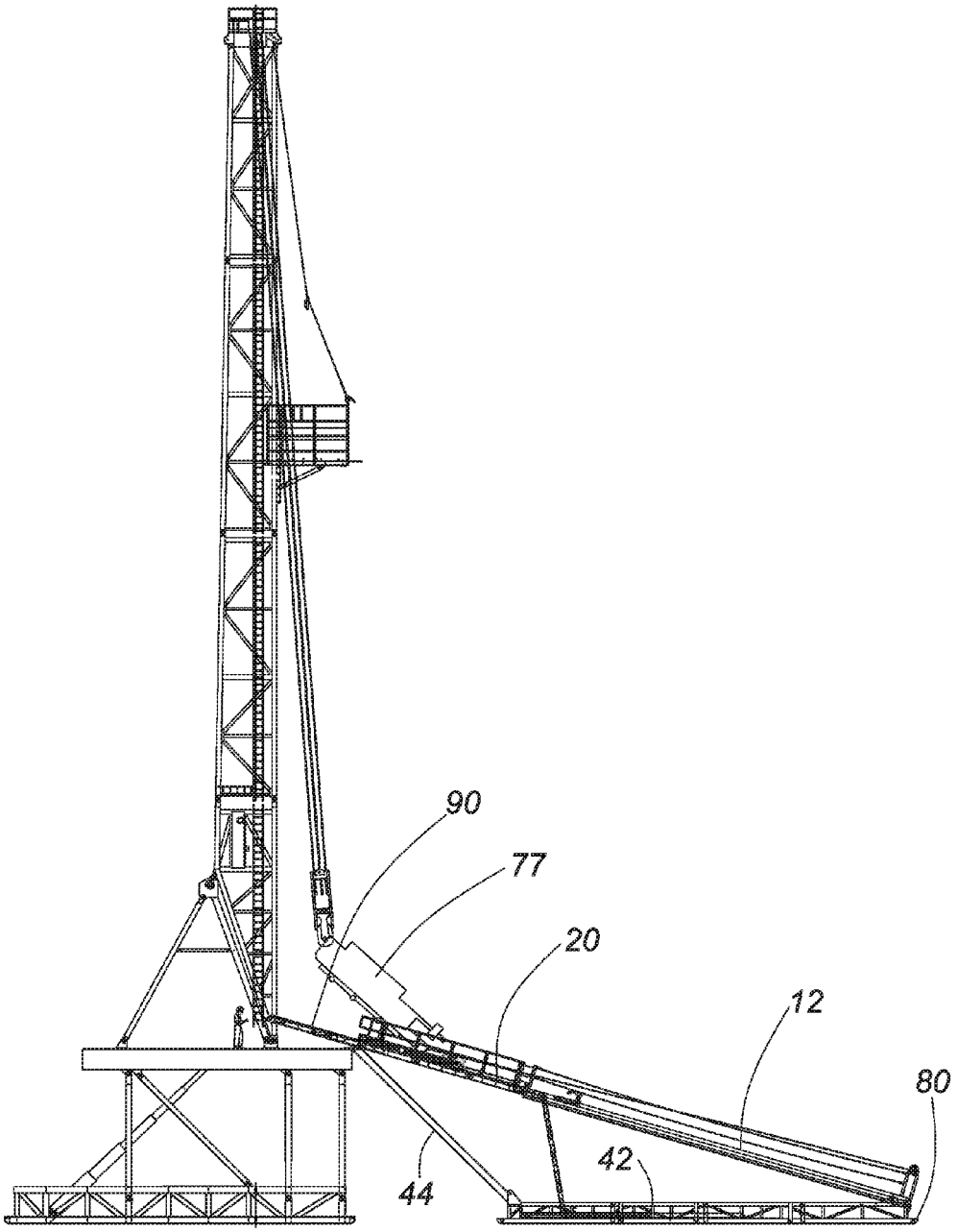

In one embodiment, the apparatus (10) also has an extension platform (90) that telescopically extends from the slide platform (20), as shown in FIG. 10D. When the apparatus (10) is in the delivery configuration, the extension platform (90) extends in substantially coplanar alignment with the delivery platform, away from the ground end (82). This allows the delivery platform to extend further over a rig floor and facilitates the delivery of the drill pipes and rig equipment in a more controlled and accurate manner. The extension platform (90) may be configured to extend to whatever length is desired by the end user. In one embodiment, the extension platform (90) may telescope out from the slide platform (20) by up to 7 feet.

In one embodiment, the apparatus (10) has safety pins (39) positioned along the periphery of the upper surface of the catwalk platform (12). These safety pins (39) are horizontally oriented when the apparatus is in the loading configuration but are actuated into a vertical position that is perpendicular to the upper surface of the catwalk platform (12) as the catwalk platform (12) is elevated. The safety pins (39) prevent drill pipes from rolling off the catwalk platform (12), as shown in FIG. 4. In one embodiment, a simple cylinder drive gear raises and lowers the safety pins (39).

In one embodiment, the apparatus (10) also has extendible hydraulic arms (34) pivotally connected to the support frame and to the catwalk platform (12), preferably at a position that is approximately equidistant from the first end (14) and the second end (16) of catwalk platform (12). When the apparatus (10) is in the loading configuration as shown in FIG. 2, the hydraulic arms (34) are retracted and in a substantially horizontal orientation. When the apparatus (10) is in the delivery configuration as shown in FIGS. 3 to 5, the hydraulic arms (34) are extended and pivot into a vertically inclined orientation. In this manner, the hydraulic arms (34) aid the piston assembly (38) in pivoting the catwalk platform (12) and the slide platform (20) into the delivery configuration.

In one embodiment, the apparatus (10) also has hydraulic stopper pins (41). In the embodiment shown in the Figures, the hydraulic stopper pins (41) are mounted in sleeves on the ground section (42) of the support frame. When the apparatus is moving from the loading configuration to delivery configuration, the stopper pins (41) rise from their sleeves and push upwardly against the catwalk platform (12), as shown in FIG. 2. In this manner, the hydraulic stopper pins aid the piston assembly (38) as it begins to drive the catwalk platform (12) and the slide platform (20) into the delivery configuration. The raised stopper pins (41) also prevent drill pipes from rolling off the pipe rack (18) and into the zone below the raised catwalk platform (12), as shown in FIG. 4. When the apparatus is moving from the delivery configuration to the loading configuration, the stopper pins (41) retract gradually into sleeves as they make contact with the descending catwalk platform (12).

In one embodiment, the apparatus (10) also has pipe racks (18). In one embodiment, as shown in FIGS. 1 to 5, the pipe racks (18) are pivotally connected to the ground section (42) of the support frame by hinged connections permitting the pipe racks (18) to be folded relative to the support frame. In the transportation configuration shown in FIG. 1, the pipe racks (18) are folded against the support frame so that they are flush and parallel with the support frame (42, 44). In the loading or delivery configurations shown in FIGS. 2 to 5, the pipe racks (18) extend outwardly from the catwalk platform (12) from one end that abuts with and is level with the catwalk platform (12) to another end that is distal to the catwalk platform.

Figure 9A:
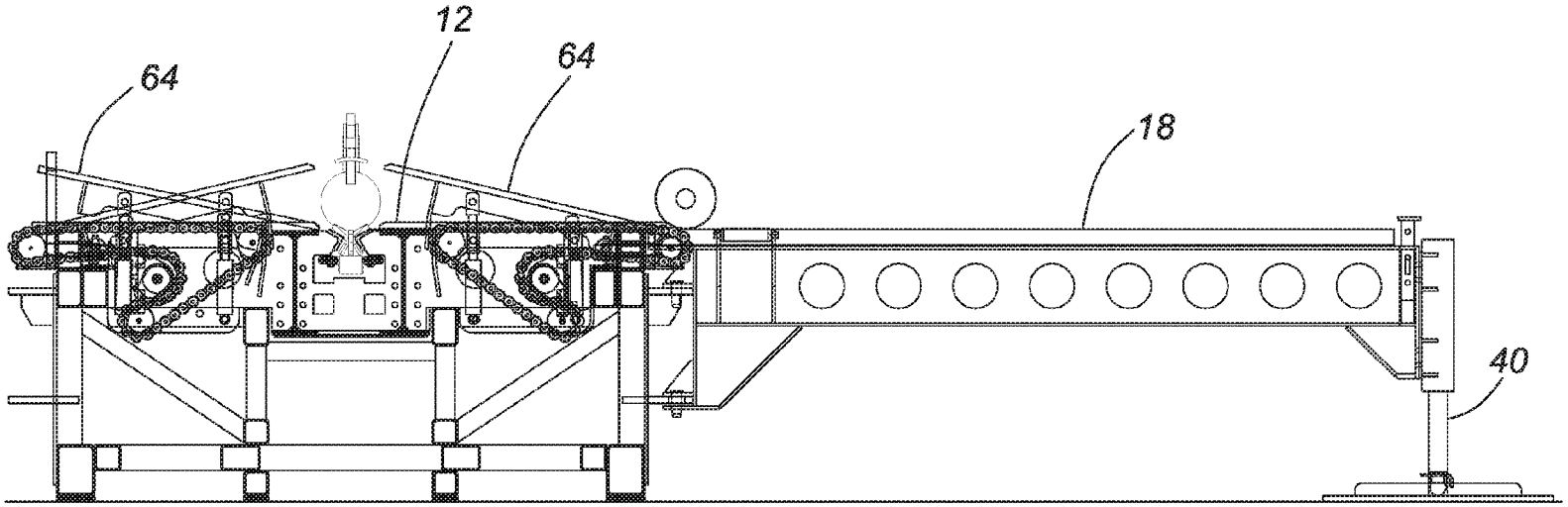
FIGS. 9A through 9C are end views of the catwalk platform of one embodiment of the apparatus of the present invention, showing the drill pipe rack in different inclinations towards the catwalk platform.
Figure 9B:
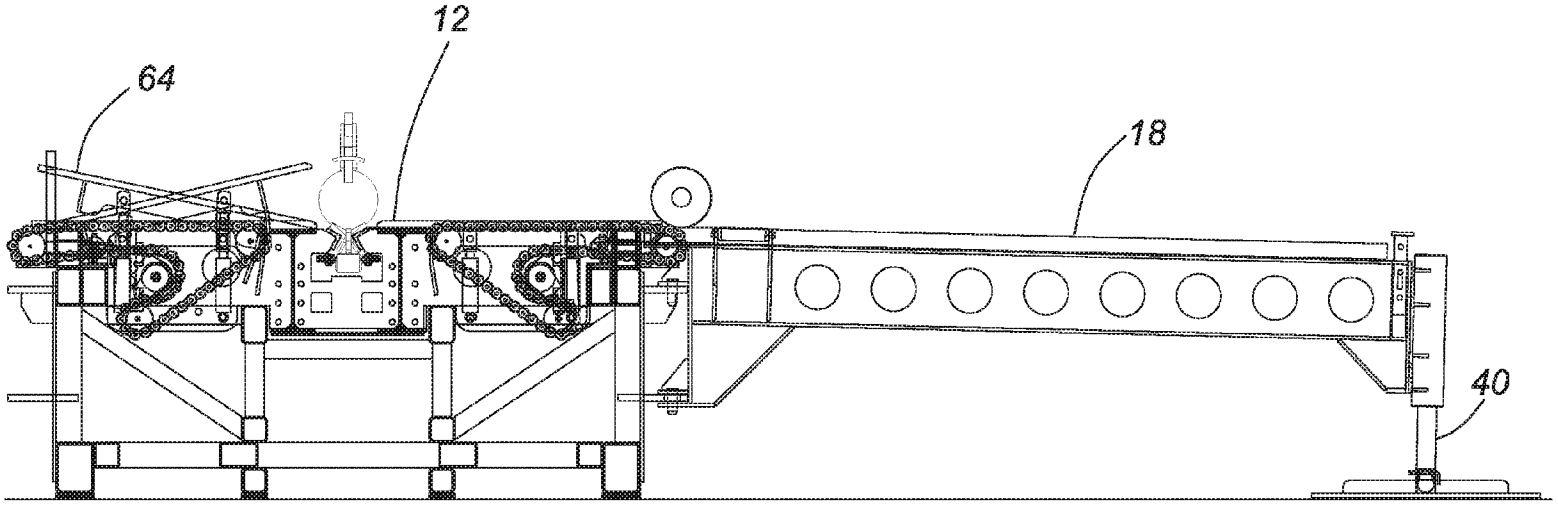
Figure 9C:
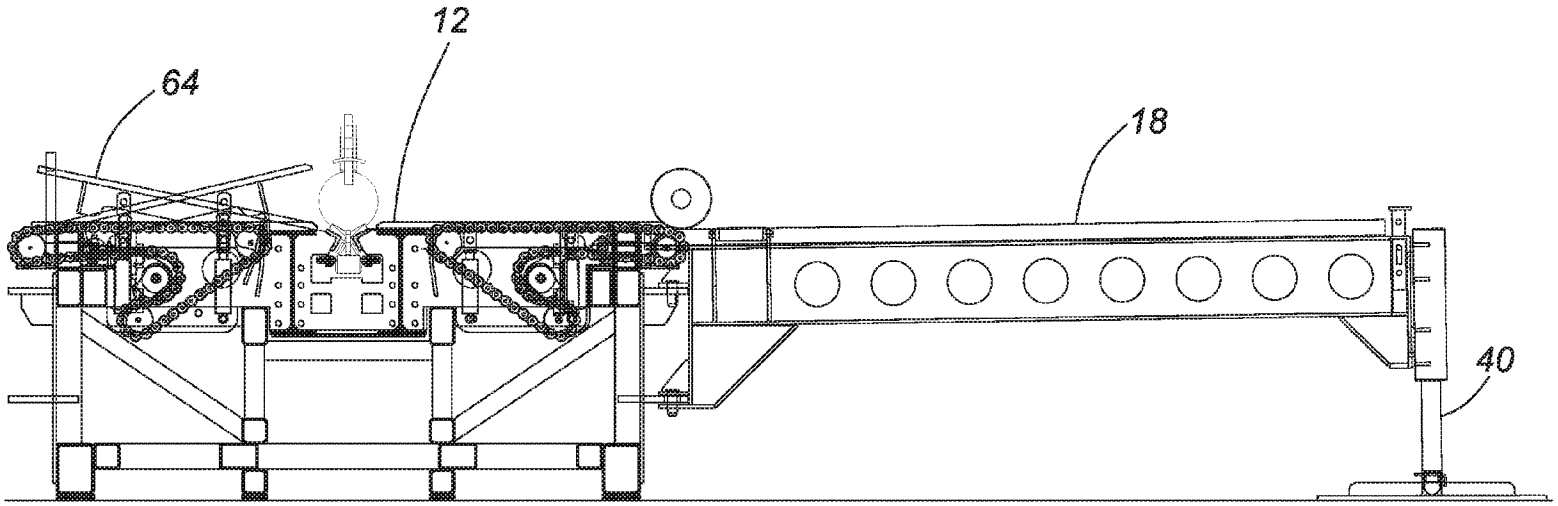

In one embodiment, the pipe racks (18) have a series of legs (40) that are variable in height, such as by hydraulic extension. These legs (40) help to stabilize the apparatus (10) and may be used in levelling the apparatus (10), as will be described below. Further, the hydraulic legs (40) may also be raised or lowered to level the pipe rack (18) with the catwalk platform (12) as shown in FIG. 9A, incline the pipe rack (18) away from the catwalk platform (12) when unloading pipe from catwalk platform (12) as shown in FIG. 9B, or incline the pipe rack (18) towards the catwalk platform (12) when loading drill pipe onto the catwalk platform (12) as shown in FIG. 9C.

In one embodiment, the catwalk platform (12) defines a trough (51) shaped to receive the drill pipe lengthwise in the skate path. In the embodiment shown in FIGS. 6 and 7, the trough (51) is formed centrally in the upper surface of the catwalk platform (12).

In one embodiment, the apparatus (10) has a conveyor (10) to selectively transport the drill pipe along the catwalk platform either to or away from the skate path. In the embodiment shown in FIGS. 6 and 7, the conveyors are implemented in the form of left and right chain drives (43) and (45) on the upper surface of the catwalk platform (12). The chain drives (43, 45) selectively transport drill pipe one at a time either laterally towards, or away from the central trough (51) and powered means (50), from either side of the trough (51).

Figure 8A:
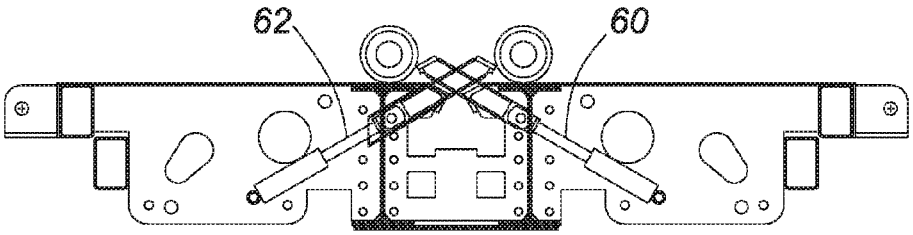
FIGS. 8A through 8D are end views of one embodiment of the apparatus of the present invention, showing the kickers in various positions.

In one embodiment, the apparatus (10) has hydraulically actuated kickers (60, 62) as shown in FIGS. 8A to 8D. The kickers (60, 62) are positioned to selectively prevent the drill pipe from entering the skate path or to kick the drill pipe out of the skate path, or both. FIG. 8A shows the kickers (60, 62) fully extended to prevent drill pipes from entering the skate path.

Figure 8B:
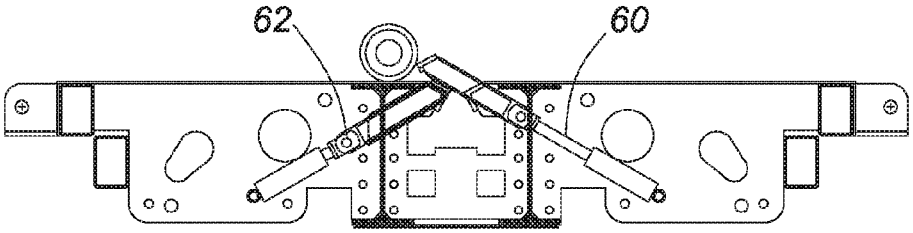
Figure 8C:
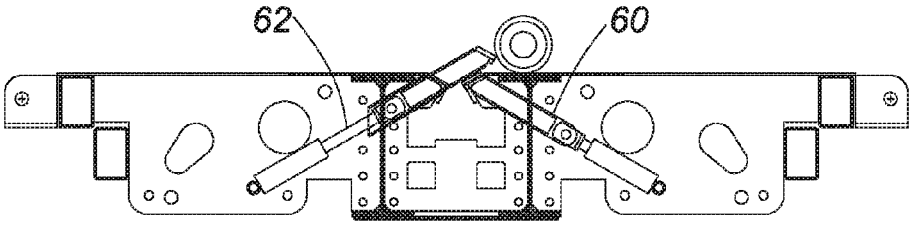
Figure 8D:
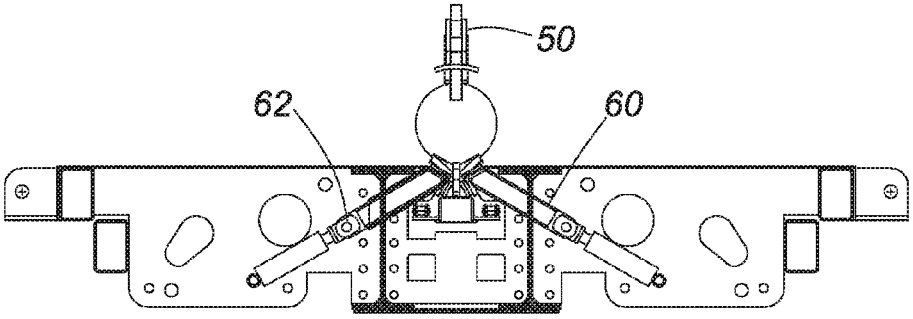

FIG. 8B shows the kicker (60) extended to push a drill pipe out of and to the left of the skate path. FIG. 8C shows the kicker (60) extended to push a drill pipe out of and to the right of the skate path. FIG. 8D shows the kickers (60, 62) fully retracted to allow the drill pipe into the skate path, ready to be raised by the powered means (50).

In one embodiment, the apparatus has indexers (64) as shown in FIGS. 9A through 9C. The indexers (64) may be used to control the delivery of drill pipe from the pipe racks (18) to the catwalk platform (12), and vice versa. In one embodiment, the indexer (64) comprises a segment of square tube and a hydraulically actuated piston connected to each end of the tube. The square tube lays lengthwise perpendicular to the length of the drill pipes and beneath the drill pipes. The pistons may be selectively actuated to extend upwardly and retract downwardly to incline the square tube either downwards towards the path so as to urge a drill pipe on the tube from the pipe rack (18) onto the catwalk platform (12), or to incline the square tube downwards away from the path so as to urge a drill pipe on the tube from the catwalk platform (12) onto the pipe rack (18). Other types of indexers known in the art may also be used to the same effect.

The aforementioned elements of the apparatus (10) may work cooperatively to provide a powered and automated system for loading drill pipe from the pipe racks (18) into the skate path, and unloading drill pipe from the skate path to the pipe racks (18), as will be explained below.

In one embodiment, as shown in FIGS. 1 to 5, the apparatus (10) has a hydraulic tailing winch (52) mounted on a pedestal on the catwalk platform (12). The pedestal may be releasably pinned to the catwalk platform (12) to facilitate removal of the winch (52). In one embodiment, the winch will have sufficient single line pull capacity for its intended purpose, which may be about 12,000 lbs. The purpose of the winch (52) is to limit uncontrolled swinging of equipment lifted by the apparatus, as is further explained below.

Figure 11A:
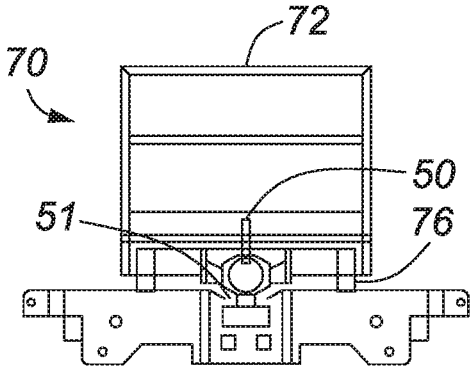
FIGS. 11 and 12A through 12D are end views and elevation views, respectively, of the basket of one embodiment of the present invention.
Figure 11B:
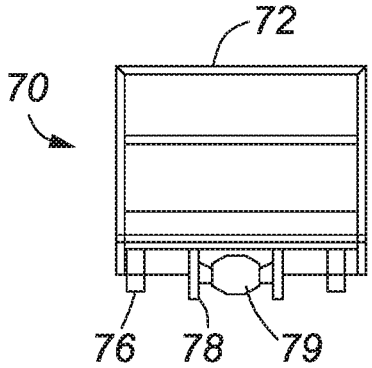
Figure 12A:
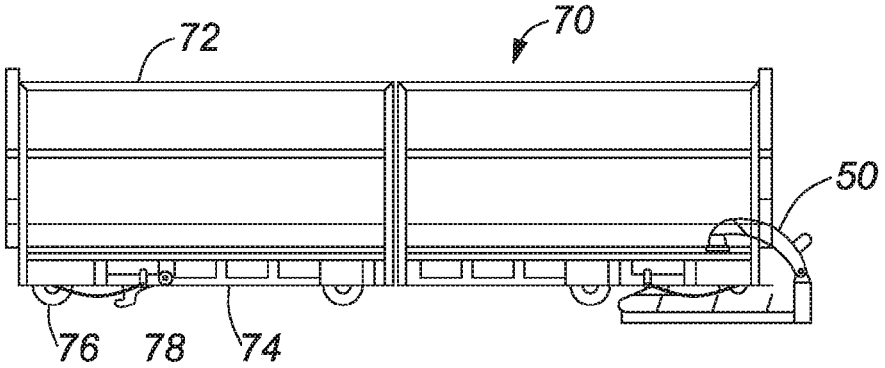
Figure 12B:
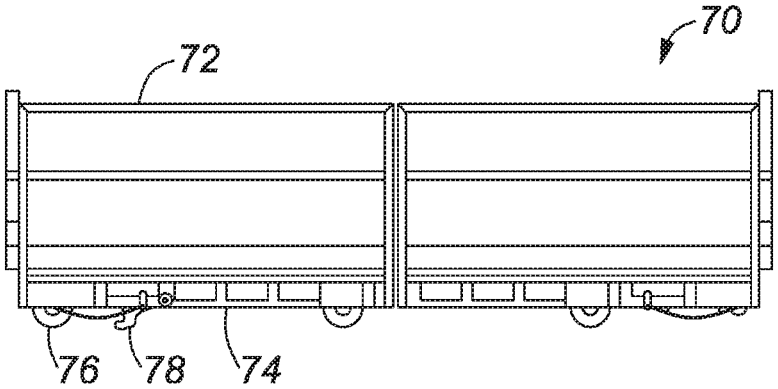
Figure 12C:
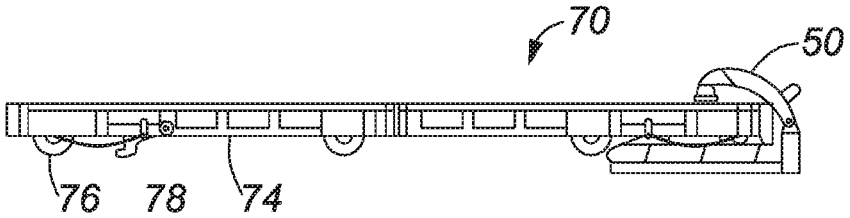
Figure 12D:
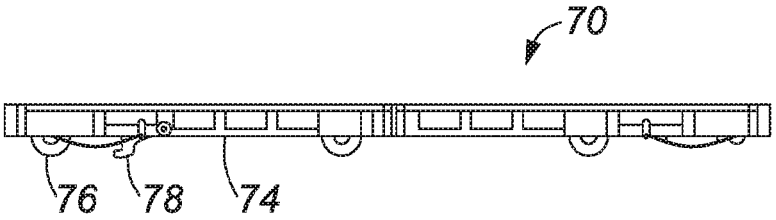

In embodiment, the apparatus (10) has a removable basket (70) that can be used to transport equipment to the rig floor. In the embodiment shown in FIGS. 12A through 12D, the basket (70) has removable rails (72), a deck (74), wheels (76), safety latch (78) and V-roller (79). As shown in FIGS. 11, 12A and 12C, the skate (50) engages the deck (74) and is used to move the basket (70) along the length of the catwalk platform (12) and the slide platform (20). The V-roller (79) fits into the trough (51) formed in the catwalk platform. The baskets (70) may be placed onto the catwalk platform and removed from the catwalk platform (12) by any suitable means such as a forklift. The basket may be loaded with equipment to be delivered to the rig floor such as slips and, as shown in FIGS. 10A through 10C, the apparatus (10) is powerful enough to deliver a top drive (77) to the rig floor. As shown in FIGS. 10B and 10C, as equipment is winched from the basket (70) to the rig floor, the line from the hydraulic tailing winch (52) is attached to the piece of equipment to provide resistance to prevent any swinging motion which would be extremely dangerous to those working on the rig floor.

The use and operation of the apparatus are now described. The apparatus (10) may be delivered in its transportation configuration, as shown in FIG. 1, to the drill rig. In one embodiment, the apparatus (10) is relatively compact in its transportation configuration so that it can be transported by conventional means, such as a low boy trailer.

At the drill rig, the apparatus (10) is placed on the ground beneath the V-door such that the longitudinal axis of the catwalk platform (12) is suitably aligned to the V-door, and the ground section (42) of the support frame rests on the ground. The catwalk platform (12) and the slide platform (20) are pivoted about hinged connection (A), and the ground section (42) and the rig section (44) of the support frame are pivoted about hinged connection (C) so that the plate (30) rests on the V-door area of the rig floor as shown in FIG. 10A. In one embodiment, the slide platform (20) is vertically inclined at approximately 45 degrees above the horizontal when the apparatus (10) is in the loading configuration. The hydraulic legs (40) are lowered to the ground and adjusted in height to level the catwalk platform (12). Blocks and shims may be placed between the ground section (42) of the support frame and the ground as required. The hydraulic legs (40) are then retracted and the hinged pipe racks (18) pivoted out from the ground section (42) of the support frame so that they extend outward from the catwalk platform (12) to support drill pipe substantially aligned with the catwalk. The hydraulic legs (40) are once again lowered to the ground. Access stairs (26) and the safety railings may then be mounted on the slide platform (20). At this point, the apparatus (10) has the configuration depicted in FIG. 2. If present, the extension platform (90) may be telescopically extended out over the rig floor by the desired amount as shown in FIG. 10D.

Figure 6:
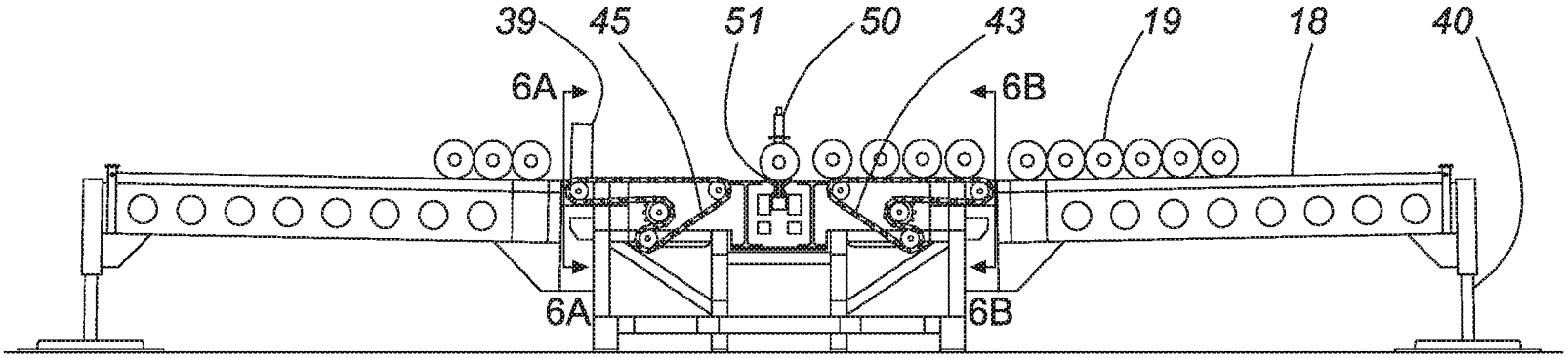
FIGS. 6 and 7 are end views of the catwalk platform of one embodiment of the apparatus of the present invention, showing the conveyors and drill pipe racks in different inclinations towards the catwalk platform.
Figure 6B:
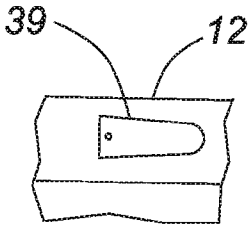
FIGS. 6A and 6B are views along sections 6A-6A and 6B-6B of FIG. 6 respectively.
Figure 6A:
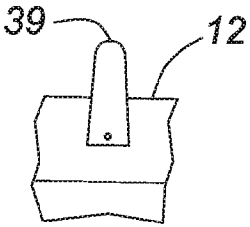
Figure 7:
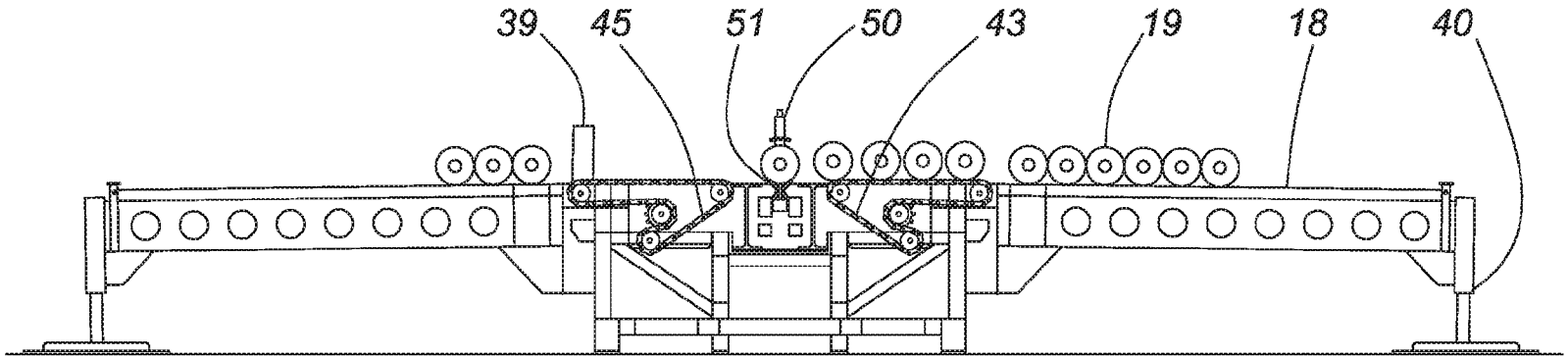

If drill pipe is to be delivered to the rig floor, multiple drill pipes (19) are loaded onto the pipe racks (18). To deliver the drill pipe from the drill pipe racks (18) to the skate path, the hydraulic legs (40) may be adjusted in height to incline the drill pipe racks (18) towards the skate path as shown in FIG. 9C, so that the drill pipes tend to roll towards the catwalk platform (12). The chain drives (43, 45) deliver lengths of drill pipe (19) one at a time to the trough (51) and allow loading from either side. Combined use of the pipe racks (18), chain drives (43 and 45), the kickers (60 and 62) and the indexers (64) allows the operator to manipulate the drill pipe about the catwalk platform (12) and into the skate path one-by-one. As shown in FIGS. 6 and 7, the chain drives (43 and 45) on the catwalk platform (12) may be loaded with a plurality of drill pipes when the apparatus is in the loading configuration. The chain drives (43 and 45), kickers (60 and 62) and indexers (64) can then be used to facilitate automatic sequential loading of the drill pipes (19) one length at a time into the trough when the apparatus (10) is in delivery configuration. For example, in one embodiment, up to 11 lengths of drill pipe may be loaded onto the catwalk platform. Conversely, multiple lengths of drill pipe may be unloaded onto the catwalk platform (12) when in the loading configuration. This distinguishes the apparatus (10) over other automated catwalk platforms that elevate but which must be raised and lowered for each individual drill pipe loading/unloading cycle.

To deliver drill pipe to the rig floor, the hydraulic pistons (38) and the hydraulic arms (34) are extended. The retractable struts (36) are pushed towards the second end (16) of the catwalk platform (12) thereby pivoting the catwalk platform (12) and the slide platform (20) until they form a single coplanar delivery platform. In one embodiment, the delivery platform is vertically inclined by approximately 15 degrees above the horizontal. The safety pins (39) and the stopper pins (41) are raised to prevent the drill pipes from rolling off the apparatus (10). At this point, the apparatus (10) is in the delivery configuration depicted in FIGS. 3, 4 and 5.

The chain drive (43) delivers drill pipe to the trough (51) and the skate (50) individually. The skate (50) is activated and the drill pipe is pushed up the catwalk platform (12) and the slide platform (20). The drill pipe is delivered to the rig floor at a relatively low angle, in one embodiment at approximately 15 degrees, and in a controlled manner. The drill pipe is then raised into the elevator and the skate (50) returns to the first end (14) of the catwalk platform (12) ready to transport the next length of drill pipe. If drill pipe is being tripped out of the well, the operation is reversed. If other types of equipment are to be transported between the ground and the rig floor, the basket (70) is placed on the catwalk platform (12).

In one embodiment, the cycle time to deliver a single drill pipe from the drill pipe rack (18) to the elevator latch point on the rig floor may be approximately 45 seconds. This time may be reduced if drill pipes are moved from the catwalk platform surface indexers (64) to the skate (50).

The interconnected catwalk platform (12) and slide platform (20), the support frame (42, 44), the retractable struts (36) and the hydraulic arms (34) collectively provide a stable delivery platform that is able to cope with heavy loads regardless of the height of the drilling floor.

The present invention may use less energy to raise a length of drill pipe to the rig floor in comparison to the use of a skate with a conventional catwalk system.

The apparatus (10) is relatively quiet compared to prior art devices and in one embodiment, the apparatus (10) operates at below 65 decibels. When in its elevated delivery configuration, workers may walk up and down the slide platform (20) and the catwalk platform (12) when the catwalk controls are not in use. In one embodiment there are dual control panels for the apparatus located at the ground level and on the rig floor.

As will be apparent to those skilled in the art, various modifications, adaptations and variations of the foregoing specific disclosure can be made without departing from the scope of the invention claimed herein.

What is claimed is:

1. An apparatus for delivering a tubular to a drill rig, the apparatus comprising:

(a) a support frame having a horizontal ground section and a pivotally connected rig section;

(b) a catwalk platform having a first end pivotally connected to one end of the ground section, and a second end;

(c) a slide platform having a first end pivotally connected to the second end of the catwalk platform, and a second end pivotally and translationally connected to one end of the rig section;

(d) a skate or conveyor for moving the tubular along a path along the catwalk platform and the slide platform; and (e) a piston assembly connected to either the catwalk platform or the slide platform, or both, to pivot the catwalk platform and the slide platform between a loading configuration and a delivery configuration;

wherein in the loading configuration, the catwalk platform is substantially horizontal and the slide platform is vertically inclined from the first end of the slide platform to the second end of the slide platform; and wherein in the delivery configuration, the catwalk platform and the slide platform are in substantially coplanar alignment to define a single delivery platform from the first end of the catwalk platform to the second end of the slide platform.

2. The apparatus of claim 1 wherein the catwalk platform comprises a first segment and a second segment, wherein the first segment comprises the first end of the catwalk platform, the second segment comprises the second end of the catwalk platform, and the first segment and the second segment are releasably connected at a point on the catwalk platform intermediate to the first end and the second end of the catwalk platform.

3. The apparatus of claim 1 wherein the skate or conveyor comprises a powered skate.

4. The apparatus of claim 1 wherein the skate or conveyor comprises a conveyor belt or conveyor chain.

5. The apparatus of claim 1 further comprising an extension platform that telescopically extends from the delivery platform away from the ground end.

6. The apparatus of claim 1 wherein the rig section may be pivoted into a transportation configuration in which the ground section and the rig section are folded against each other.

7. The apparatus of claim 6 wherein in the transportation configuration, the ground section, the rig section, the catwalk platform and the slide platform are folded against each other.

8. The apparatus of claim 1 further comprising a rack pivotally connected to the support frame for moving to the rack from a transportation configuration in which the rack is folded against the support frame to the loading configuration in which the rack extends outwardly from the catwalk platform.

9. The apparatus of claim 8 further comprising an extendible leg attached to the rack, wherein the extension of the leg varies the inclination of the rack relative to the catwalk platform.

10. The apparatus of claim 1 further comprising a conveyor to selectively laterally transport the tubular along the catwalk platform either to or away from the path.

11. The apparatus of claim 10 wherein the conveyor comprises a chain drive.

12. The apparatus of claim 10, wherein the catwalk platform is adapted to hold a plurality of tubulars.

13. The apparatus of claim 12, wherein the plurality of tubulars comprises between 2 and 11 tubulars.

14. The apparatus of claim 13, wherein the plurality of tubulars comprises between 5 and 11 tubulars.

15. The apparatus of claim 1 further comprising an indexer to selectively laterally transport the tubular either to or away from the path.

16. The apparatus of claim 1 further comprising a hydraulically actuated kicker positioned to selectively prevent the tubular from entering the path or to kick the tubular out of the path, or both.

17. The apparatus of claim 1 further comprising a removable basket engaged by the skate or conveyor to, when the apparatus is the delivery configuration, travel along the delivery platform.

18. The apparatus of claim 1 wherein the piston assembly comprises a hydraulic cylinder.

19. The apparatus of claim 18 wherein the hydraulic cylinder is disposed between the ground section and the catwalk platform, substantially parallel to both when the apparatus is in the loading configuration.

20. The apparatus of claim 1, further comprising side safety railings extending between the first end and the second end of the slide platform.

21. The apparatus of claim 1, further comprising side safety railings extending between the first end and the second end of the catwalk platform.

22. The apparatus of claim 21, wherein the side safety railings provide a horizontally open gap, at an upper surface of the catwalk platform, adapted to allow a tubular to pass though the side safety railings.

23. The apparatus of claim 1, further comprising safety pins positioned along the periphery of an upper surface of the catwalk platform, the safety pins moveable between a horizontal position in the loading configuration and a vertical position in the delivery configuration.

* * * * *